US005190674A

United States Patent [19]

Monks

[11] Patent Number: 5,190,674

[45] Date of Patent: Mar. 2, 1993

[54] METHOD AND APPARATUS FOR CONTROLLING THE FLOW OF MOLTEN METALS

[76] Inventor: James H. Monks, 1 Guisborough Road, Nunthorpe, Middlesborough, Cleveland TS7 0LE, England

[21] Appl. No.: 777,403

[22] PCT Filed: Apr. 4, 1991

[86] PCT No.: PCT/GB91/00524

§ 371 Date: Oct. 3, 1991

§ 102(e) Date: Oct. 3, 1991

[87] PCT Pub. No.: WO91/15320

PCT Pub. Date: Dec. 17, 1991

[30] Foreign Application Priority Data

Apr. 4, 1990 [GB] United Kingdom ..... 9007618
Dec. 20, 1990 [GB] United Kingdom ..... 9027661

[51] Int. Cl.[5] ..... B22D 41/58; B22D 39/06

[52] U.S. Cl. ..... 222/590; 222/595; 266/239

[58] Field of Search ..... 266/236, 239, 45; 222/595, 590; 75/584

[56] References Cited

U.S. PATENT DOCUMENTS

| | | | |
|---|---|---|---|
| 3,552,478 | 1/1971 | Lauener | 164/64 |
| 3,608,621 | 9/1971 | Bollig et al. | 164/64 |
| 4,340,160 | 7/1982 | Van Geel | 222/595 |
| 4,394,006 | 7/1983 | Bedell | 266/239 |

FOREIGN PATENT DOCUMENTS

| | | |
|---|---|---|
| 0189313 | 7/1986 | European Pat. Off. . |
| 988137 | 4/1965 | United Kingdom . |
| 1323598 | 7/1973 | United Kingdom . |
| 1335868 | 10/1973 | United Kingdom . |
| 1390636 | 4/1975 | United Kingdom . |
| 1399914 | 7/1975 | United Kingdom . |
| 1413002 | 11/1975 | United Kingdom . |
| 1574321 | 4/1976 | United Kingdom . |
| 2159007 | 5/1985 | United Kingdom . |
| 2223969 | 4/1990 | United Kingdom . |

OTHER PUBLICATIONS

Patent Abstracts of Japan, vol. 7, No. 104, (M212) [1249], May 6, 1983, & JP, A, 5825863 (Fuji Denki Seiko Ltd.), Feb. 16, 1983.

*Primary Examiner*—Scott Kastler
*Attorney, Agent, or Firm*—Ingersoll Buchanan

[57] ABSTRACT

The invention provides a method of controlling the flow of molten metal from a holding vessel such as a tundish through a discharge orifice into a receptacle such as a mould; the method comprising (i) providing within the holding vessel a flow control chamber comprising a down-flow chamber separate from but in fluid communication with the interior of the holding vessel, the down-flow chamber having an outlet at its lower end, said outlet leading to or forming part of the discharge orifice, and an opening towards or at its upper end; (ii) creating a gas pressure within the flow control chamber sufficient to allow molten metal from the holding vessel to pass through the opening to establish in the lower end of the down-flow chamber a column of molten metal with a volume of gas occupying the upper end of the flow control chamber and serving to separate the column of molten metal from the opening, whereby an equilibrium is established between molten metal passing through the opening and molten metal passing out through the discharge orifice such that the height of the column of molten metal in the down-flow chamber remains substantially constant; and (iii) (a) reducing the said volume of gas, thereby to increase the height of the column of molten metal and thus the flow rate through the discharge orifice, or (b) increasing the said volume of gas, thereby to reduce the height of the said column and thus the said flow rate. The flow control chamber suitably is a refractory body having a hollow interior divided by a central weir into up-flow and down-flow chambers. The invention also provides a refractory flow control chamber per se and a flow control system including the chamber.

21 Claims, 3 Drawing Sheets

METHOD AND APPARATUS FOR CONTROLLING THE FLOW OF MOLTEN METALS

The invention relates to method and apparatus for controlling the flow of molten metals from a melt-containing vessel, such as a tundish, into a melt-receptacle, such as a continuous caster.

Hitherto, especially in the field of continuous casting, regulating the flow of molten steel from one vessel to another has been accomplished by means of various refractory stoppers, sliding gate valves or rotary valves. A disadvantage with such devices is that they rely upon the integrity of refractory components moving together. Moreover, they can be expensive to acquire and maintain, and time-consuming to fit and remove. The only currently used flow-control method, of which the applicants are aware, having no moving refractory parts and where no activator is needed, is the metering nozzle system. The limitation of such a system is that the throughput cannot be altered in a controlled manner during casting and, moreover, any significant nozzle-bore erosion or blockage means that casting has to be terminated.

Several flow control systems have previously been described in which moving refractory components have been eliminated and flow of molten metal has been controlled instead through the use of gas pressure. Thus for example, U.S. Pat. No. 3,608,621 describes the use of a refractory column which is located above the discharge nozzle in a holding vessel for molten metal. The lower portion of the column is divided by a weir into an up-flow chamber which has a molten-metal inlet at its lower end, and a down-flow chamber which has an outlet leading to the discharge nozzle at its lower end. The up-flow chamber has an annular array of gas pipes or an annular gas-permeable refractory brick at its lower end just above the inlet. Molten-metal flow through the device is brought about by injecting gas into the molten metal such that the body of metal is caused to spill over the weir into the down-flow chamber. It would appear that this method requires a constant flow of gas during a metal pouring process. The use of a constant flow of gas would not only render the process significantly more costly but in addition could be expected to exert a significant chilling effect on the system.

U.S. Pat. No. 4,394,006 describes a flow control system wherein a gas bubble is created in a chamber above the discharge nozzle of the molten-metal holding vessel. The chamber is defined, in part, by a weir which separates the body of molten metal from the nozzle. The pressure of the gas bubble prevents molten metal from spilling over the weir into the nozzle. Molten metal flow is initiated by reducing the gas pressure in the chamber thereby allowing metal to pass into the chamber and spill over the weir. However, this method suffers from the disadvantage that it is essentially an on-off system which does not allow for fine control and adjustment of molten metal flow rate.

It is an object of the present invention to provide a reliable and sensitive flow-control system in melt-containing vessels, which is capable of being quickly assembled by non-technical personnel, and which requires neither modification of the melt-containing vessel, nor mechanical activation mechanisms. It is a further object of the present invention to provide a means of overcoming the problems of the aforementioned flow-control systems.

The present invention provides a method of controlling the flow of molten metal from a holding vessel such as a tundish through a discharge orifice into a receptacle such as a mould; the method comprising (i) providing within the holding vessel a flow control chamber comprising a down-flow chamber separate from but in fluid communication with the interior of the holding vessel, the down-flow chamber having an outlet at its lower end, said outlet leading to or forming part of the discharge orifice, and an opening towards or at its upper end;

(ii) creating a gas pressure within the flow control chamber sufficient to allow molten metal from the holding vessel interior to pass through the opening to establish in the lower end of the down-flow chamber a column of the molten metal, with a volume of gas occupying the upper end of the flow control chamber and serving to separate the column of molten metal from the opening, whereby an equilibrium is established between molten metal passing through the opening and molten metal passing out through the discharge orifice such that the height of the column of molten metal in the down-flow chamber remains substantially constant; and (iii) (a) reducing the said volume of gas thereby to increase the height of the column of molten metal and thus the flow rate through the discharge orifice, or (b) increasing the said volume of gas thereby to reduce the height of the said column and thus the said flow rate.

The method of the invention thus involves establishing a bubble of gas above the column of molten metal in the down-flow chamber. Fine control of the flow of molten metal through the discharge orifice is achieved by regulating the height of the column in the down-flow chamber which in turn is regulated by controlling the volume of the gas bubble. Thus, reducing the volume of the bubble by withdrawing gas from the flow control chamber leads to an additional amount of molten metal being drawn through the opening to increase the height of the column, whilst increasing the volume of the bubble by introducing gas into the flow control chamber has the opposite effect.

Altering the flow rate is achieved by altering the volume of gas within the flow control chamber, and not the gas pressure. Although momentary fluctuations in pressure may occur when gas is removed from, or introduced into, the flow control chamber, the gas pressure rapidly restores itself to a value (hereinafter referred to as the equilibrium value or equilibrium pressure) which is constant for a given head of molten metal in the holding vessel.

It will be understood that as molten metal issues through the discharge orifice, thereby acting to lower the height of the molten metal column in the down-flow chamber, a compensatory flow of molten metal through the opening into the down-flow chamber takes place, thereby acting to increase the height of the column. In this way an equilibrium is established between liquid metal entering the chamber through the inlet and metal leaving the chamber through the discharge orifice.

As indicated above, the equilibrium gas pressure depends upon the head of metal in the holding vessel. The opening towards the upper end of the chamber defines a weir over which the molten metal must pass before entering the chamber and if the height of the weir is lower than the head of molten metal within the holding vessel, then a positive pressure will obtain within the chamber when an equilibrium or self-regulating condition has been achieved. Conversely, if the weir is higher than the said head of molten metal, the equilibrium gas pressure within the chamber will be negative. In each case the magnitude of the pressure within the chamber, positive or negative, will depend upon the magnitude of the difference in heights between the weir and the head of molten metal in the holding vessel. It will be understood that if the head of molten metal in the holding vessel remains constant, then so too does the gas pressure required within the chamber in the equilibrium condition.

In order to increase the rate of flow through the discharge orifice, the height of the liquid metal column in the chamber must be increased and this is conveniently achieved by applying a pulse or series of controlled pulses of relatively negative pressure to the chamber via an appropriately situated gas port. The effect of the pulsed negative pressure is to disturb the equilibrium by lowering the pressure momentarily, thereby drawing molten metal over the weir into the chamber at a faster rate. The height of the column of molten metal immediately increases until the volume of the gas above the column has reduced sufficiently to accommodate the momentarily reduced pressure (in accordance with the gas equation $PV=a$ constant) thereby immediately restoring the pressure to the equilibrium value. In an analogous manner, the flow rate is reduced by reducing the height of the liquid metal by applying a pulse or series of pulses of relatively positive pressure. It should be understood that although the gas pressure returns rapidly to the equilibrium value, the height of the liquid metal column stabilises at its new level.

Thus, in accordance with the invention, the flow rate can be adjusted rapidly, and in a finely controlled manner, by regulating the height of the column of metal in the down-flow chamber.

The references to positive and negative pressure as used herein are used in a relative sense. For example, if the equilibrium system pressure is a positive pressure, a pulse of negative pressure can be provided simply by momentarily venting the system to atmosphere. Conversely, if the equilibrium system pressure is negative, momentarily venting the system to atmosphere could constitute a pulse of positive pressure. Pulses of positive pressure may conveniently be provided from a positive pressure accumulator containing an inert gas such as nitrogen or argon.

The flow control chamber may be formed integrally with the holding vessel, or may be a permanent or semi-permanent fixture within the vessel. However, it is preferred that the chamber forms part of a flow control device which is a separate entity. Advantageously the flow control device is constructed such that it can be used in conjunction with conventional molten-metal holding vessels such as tundishes without the need to modify the vessel in any way. For example the flow control device may be adapted to be joined to, abut against, or form part of the discharge orifice (e.g. nozzle) in the holding vessel and, in this respect, can replace nozzle stopping devices such as a stopper rod or rotary valve assembly. Where a holding vessel has a plurality of discharge orifices, each such orifice may be fitted with such a flow control device.

The flow control chamber may comprise, in addition to the aforesaid down-flow chamber, an up-flow chamber, the up-flow and down-flow chambers being linked for molten metal flow therebetween by the opening towards the upper end of the down-flow chamber, wherein the up-flow chamber has, at a point below the said opening, an inlet through which molten metal from the holding vessel may pass. It will be appreciated that the said opening constitutes a weir between up-flow and down-flow chambers.

In one embodiment the present invention provides, for use in the method as hereinbefore defined, a flow-control device for molten metal comprising a refractory body, the hollow interior of which defines mutually laterally disposed integral first and second melt-receiving chambers, which chambers are linked for molten metal flow therebetween by an opening located at a point remote from the lower ends of the chambers; the first chamber constituting an up-flow chamber and having an inlet at a point below the opening linking the first and second chambers; the second chamber constituting a down-flow chamber and having an outlet at or near its lower end through which molten metal may be dispensed; the refractory body being adapted to be located in a melt-containing vessel such that the said outlet can be secured against a discharge orifice of the vessel; wherein the refractory body has a gas port or ports opening into said hollow interior, the gas port or ports in use being connected to means for selectively venting the chambers to atmosphere and lowering and raising the pressure within the chambers; characterised in that the gas port or ports is or are disposed above the opening linking the first and second chambers and, for example, constitute the sole means of introducing gas into the hollow interior of the body.

In the aforesaid embodiment the first and second chambers are mutually laterally disposed. Typically, they are disposed side by side, although in principle one chamber may enclose the other. For example, the first and second chambers may comprise concentric outer and inner tubular elements. In one particular embodiment, the first and second chambers share a common wall.

It is preferred that the opening linking the first and second chambers takes the form of a third chamber disposed above the first and second chambers. In such an arrangement, the gas port or ports can be located at or near an upper end of the third chamber.

In one preferred embodiment, the refractory body is a column in the form of a tube, the lower part of the tube being divided by a central weir into two separate galleries which constitute the first and second chambers.

In practice, the refractory body will be located inside a melt-containing vessel such as a tundish and will be adapted for location above an outlet nozzle in the vessel. The dimensions of the body may be chosen such that the opening linking the first and second chambers is above, below, or at the same height as the level usually reached by the molten metal in the vessel. When the opening is above the said level, molten metal cannot be caused to pass through the linking opening and down through the outlet of the second chamber by metallostatic pressure alone. A further motivating force, namely a reduction of the pressure within the refractory body, is necessary to bring about molten metal flow. Clearly, this will not apply when the opening is beneath the level usually reached by the molten metal and, to the contrary, a positive pressure may be initially established in the refractory body to prevent the flow of molten metal therethrough.

In order that the volume of gas within the flow control chamber may be varied in a finely controlled manner, the flow control chamber is connected to means for introducing gas into, or removing gas from, the flow control chamber. The means for removing gas from, or adding gas to, the chamber may be, respectively, a negative pressure accumulator or positive pressure accumulator. The positive pressure accumulator advantageously contains a non-oxidising gas such as nitrogen or argon. The accumulators are controlled by valves, typically solenoid valves. A vent to atmosphere may also be provided and this too is controlled by a valve, preferably a solenoid valve.

The means for introducing gas into, or removing gas from, the flow control chamber may be controlled manually, or may be partially or fully automated. For example, in order to automate the control method, a pneumatic controller may be used. The controller can be connected to the gas introducing/removing means and/or the vent to atmosphere. Suitably the controller is linked to the solenoid valves via an appropriate control circuit.

The pneumatic controller is preferably a programmable controller and such controllers are widely available. The controller ideally should be capable of opening and closing the various valves within the system in a predeterminable and timed manner so as to provide pulses of positive or negative pressure of predeterminable duration, for example as little as b 100 milli-seconds and up to e.g. 5 seconds in length. The pneumatic controller can be linked to various signal-generating monitoring means such as, for example, a pressure transducer which is in fluid communication with the interior of the flow control chamber. The pressure transducer is conveniently located in an off-take pipe linked to a gas port in the flow control chamber. The pressure transducer provides a means of continuously monitoring the pressure within the chamber.

The pneumatic controller may advantageously be linked, for example by means of closed control loops, to signal-generating monitors in the receptacle and/or a feeder vessel (e.g. a ladle) which supplies molten metal to the holding vessel. For example, where the receptacle is a mould, e.g. of a continuous caster, the pneumatic controller may be linked to an automatic meniscus monitoring device (autolevel device) at or near the mouth of the mould. Thus if the molten metal level in the mould falls outside predetermined limits, the pneumatic controller in response to an appropriate signal from the auto level device would be programmed to actuate an appropriate valve to adjust the volume of gas within the flow control chamber thereby altering the column height in the down-flow chamber and hence the rate of pouring. Additionally or alternatively, the pneumatic controller may be linked to means for monitoring the casting speed, e.g. a tachometer located on the various strand drives of the caster. Typically at the beginning of a continuous casting process, the mould is filled at a slow steady rate, the start of withdrawal from the mould being slow, consistent with safety at this critical time. Once withdrawal of the cast section from the mould begins, the casting-speed signal from the tachometer on the strand drives is monitored by the pneumatic controller which can be programmed or adjusted manually to reduce the gas volume within the flow control chamber to increase flow of molten metal therethrough.

In general, it is preferable to keep the molten metal in a holding vessel such as a tundish at a constant level. It is therefore useful to have means for controlling the pouring of molten metal from a feeder vessel such as a ladle into the holding vessel. The controlling means can be, for example, a sliding gate valve and such means can be made actuable in response to an electronic signal from the pneumatic controller. For example, if the pneumatic controller senses that the level of molten metal in the holding vessel is falling (e.g. because of decreasing pressure within the flow control chamber) an appropriate signal can be sent to the sliding gate actuating mechanism on the feeder vessel to cause it to increase the feed rate of molten metal.

Further monitoring means may include various safety devices such as an earth probe mounted in the upper part of the flow control chamber. Such a probe would detect unacceptably high liquid metal levels in the chamber, and the resulting signal to the pneumatic controller would enable the rate of flow of molten metal into the chamber to be reduced, either by manual actuation or automatically.

The alterations in gas volume in the flow control chamber preferably are achieved by means of a pulse or pulses of positive or negative pressure. The controller suitably is programmed such that after each applied pulse, it receives and processes signals from each of the monitoring instruments to which it is linked and can then make further adjustments to the molten metal flow rate as required. In this way, very fine control of flow rate may be achieved. The aforementioned monitoring and control functions can of course also be effected manually.

The invention will now be described in more detail by reference to the drawings, in which.

Figure 1:
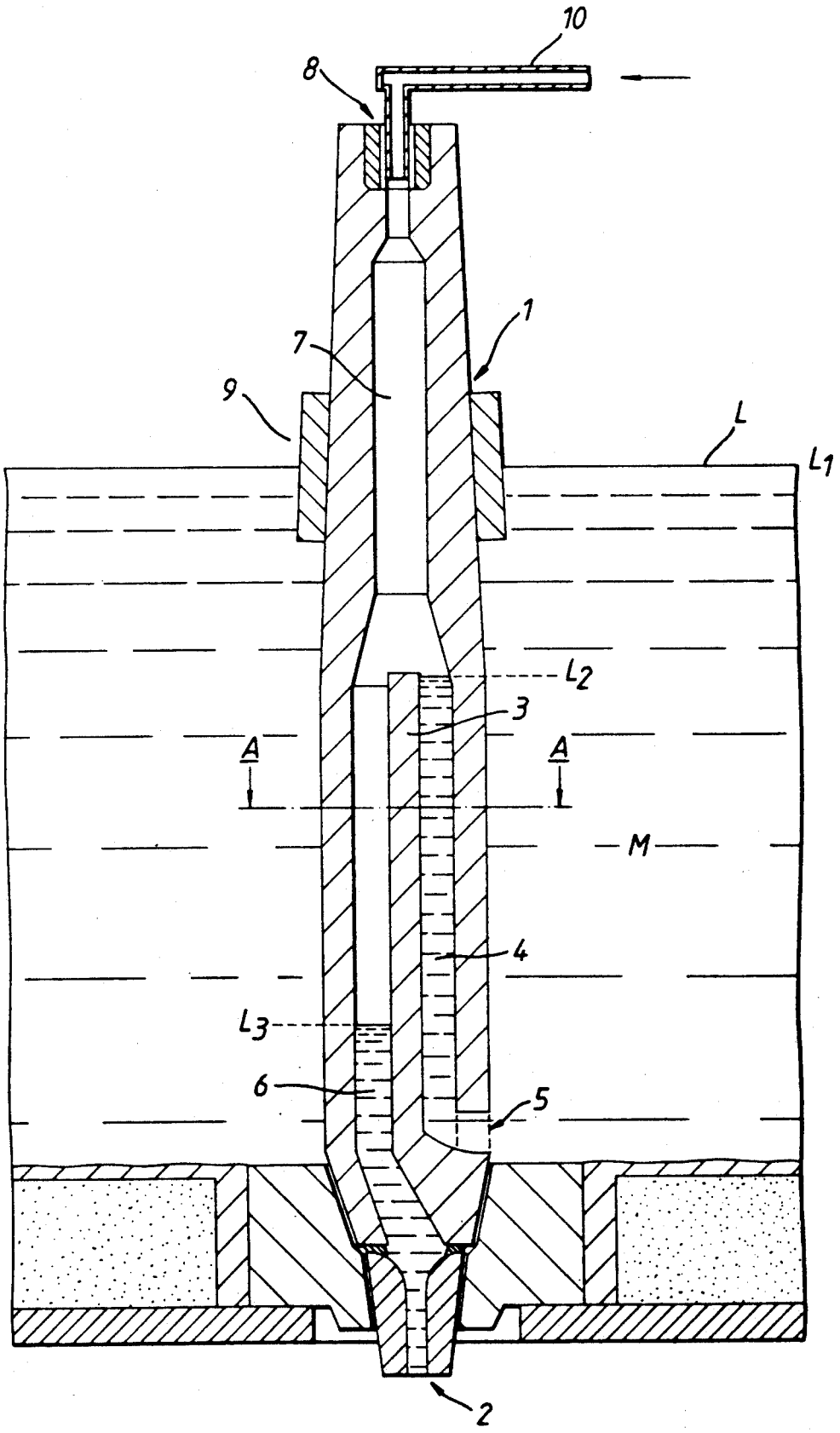
FIG. 1 is a sectional view from a side elevation of an apparatus according to one embodiment of the invention.
Figure 3:
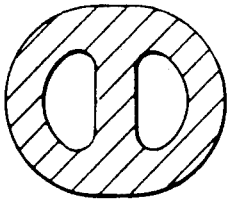
FIG. 3 is a sectional view along the line AA in FIGS. 1 and 2.

Thus, the embodiment illustrated in FIG. 1 comprises a tubular ceramic column (1) located over an outlet nozzle (2) set into the base of a melt-containing vessel such as a tundish. The tapered base of the column (1) in use is cemented into a suitable seating-block over the nozzle (2). The hollow interior of the column (1) is divided by a central integrally formed weir (3), into a first or up-flow chamber (4), a second or down-flow chamber (6) and an upper chamber (7). The up-flow chamber (4) is provided at its lower end with an opening (5) through which molten metal from the reservoir M can pass. As can be seen from FIG. 3, in this embodiment the first and second chambers are of approximately the same cross-sectional area and are generally semi-circular in cross-section. However, they need not be of the same cross-sectional area and the precise cross-sectional shape is not important. Encircling the column at a level (L) to which the melt-containing vessel is normally filled, is a sheath (9) of refractory material which serves to protect the column from the erosive effects of surface slag. Instead of a sheath (9), the column (1) could be provided with a thickened wall portion which would serve the same purpose.

Figure 4:
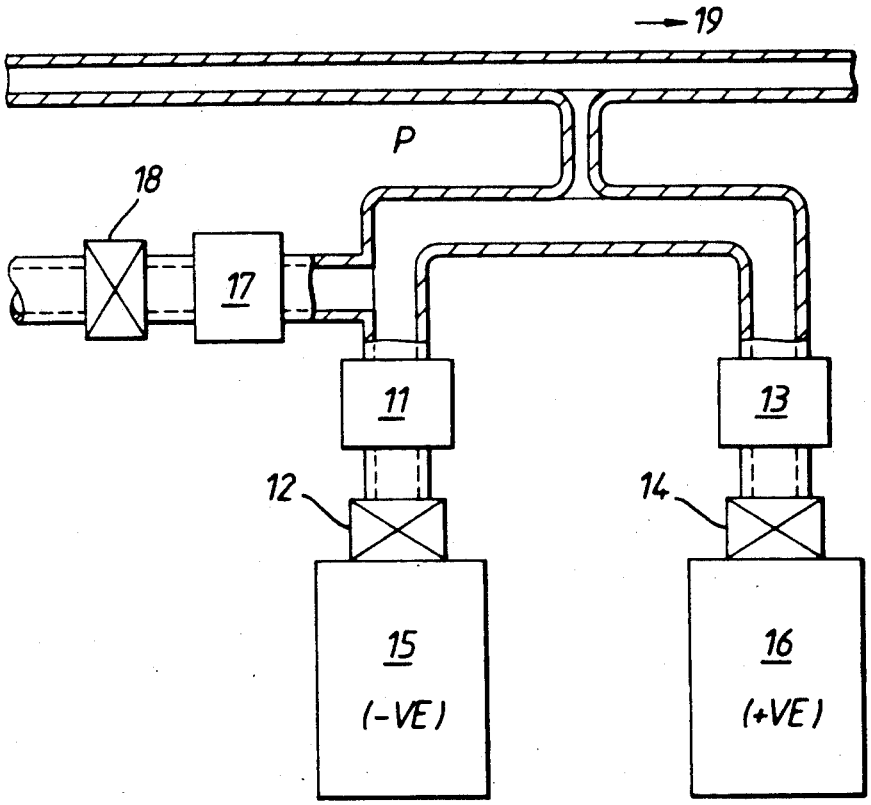
FIG. 4 illustrates, schematically, pneumatic control equipment which can be used in conjunction with the embodiments shown in FIGS. 1 and 2.

Set into the top of the column is a metal fitment (8), to which is removably attached a flexible steel hose (10) leading to a pneumatic control system P. The pneumatic control system P is illustrated in FIG. 4. It comprises solenoid valves (11) and (12) to tap into a negative pressure accumulator (15), and solenoid valves (13) and (14) which control the output of a positive pressure argon accumulator (16). Valves (14) and (12) are variable restrictors which allow fine control of positive or negative pressure respectively. Solenoid valves (17) and (18), of which (18) is a variable restrictor valve, control a vent to atmosphere. An off-take (19) leads to a remote pressure transducer, the electrical output from which is monitored by a programmable controller. The controller can energise, as required any of the abovementioned valves, allowing them to be opened for specified time intervals.

The mode of operation of the apparatus will now be described.

Before commencing the molten-metal pouring operation, the refractory column is thoroughly pre-heated in the empty melt-containing vessel. The outlet nozzle (2) is pre-heated using a separate oxygen-propane heating lance. Prior to liquid metal being introduced into the vessel, a refractory plug, pad or board (not shown) is located in or over the outlet nozzle (2) in order to permit the system to be pressurized. Liquid metal is then introduced into the vessel in known fashion to fill the vessel slowly to a pre-determined operating level ($L_1$). The vessel generally will have a plurality of nozzles, commonly between four and six, and during a metal pouring operation (e.g. during a casting cycle), the vessel typically is continuously replenished by a ladle such that $L_1$ remains more or less constant. During the initial filling of the vessel a small flow of argon gas is metered into the system via valve (14), sufficient to preclude liquid entering the inlet port (5). The pressure at which gas bubbles begin to escape from port (5) creates characteristic fluctuations in system pressure enabling the controller to compute the precise liquid metal depth. As the escape of gas is detected, valve (14) is de-energised for a short interval before repeating the sequence to re-assess the vessel depth $L_1$.

When the vessel has been filled, or while it is being filled, a purge cycle is initiated. The intention of the purge is to provide further pre-heating of the refractory column and ensure fresh liquid is used in the actual start. The purge cycle will now be described.

STAGE 1

Solenoid valve (18) opens for controlled vent to atmosphere via a restrictor and the level ($L_2$) in (4) rises. Having ascertained the level $L_1$ as described above, the pressure within the column is regulated to ensure that the molten metal, in ascending chamber (4), does not pass over the top of the weir (3).

STAGE 2

Valve (18) closes and valve (14) opens, via the restrictor, to introduce argon gas thereby to expel the liquid from up-flow chamber (4). When gas escapes at (5), the controller again makes an assessment of metal depth $L_1$ in the vessel.

STAGE 3

Stage 1 is repeated, i.e. the molten metal is re-admitted via inlet (5) into chamber (4) to re-assume a level below weir height. This purging procedure may be repeated several more times if desired until the column is adjudged to be thoroughly warmed.

When it is desired to allow molten metal over the weir (3) into the down-flow chamber (6) and thence into the nozzle (2), the pressure inside the column is reduced to a level at which the molten metal can ascend chamber (4) to a point below the weir (3), and then the chamber is subjected to controlled venting for a predetermined time interval. There is an immediate flow of liquid metal over the weir (3) into chamber (6) to give rise to a column of molten metal therein. Having thus primed the down-flow chamber, the stopper or pad is removed so that the liquid metal issues through the nozzle (2). The gas occupying the upper chamber (7) becomes entrapped between the molten metal in the up-flow chamber (4) and the molten metal column in the down-flow chamber (6).

The molten metal flows through nozzle (2) at a rate determined by the combined effects of the metallostatic pressure of the column in the chamber (6) and the gas pressure acting upon it; the outflow itself acts to lower system pressure, which again allows the up-flow level in chamber (4) to rise over the weir (3) thereby restoring supply to the down-flow column.

The cycle continues, with the incoming molten metal acting to increase the pressure of the gas in chamber (7) and the out-flowing liquid metal acting to reduce the pressure. A self-regulating condition develops within the column, input matching output, the height of the level in the down-flow chamber (6) remaining steady. At this point, the system pressure will indicate exactly the difference in heights between the weir (3) and the molten metal level in the tundish. This "critical value" remains the same for any height of column in the down-flow chamber (6), for a given level of molten metal in the tundish.

Alternative start procedures are possible. For example, the venting step which brings about the initial flow of molten metal over weir (3) may be effected simply by removing the stopper or pad from the nozzle (2) rather than by venting via solenoid valve (18). As a further alternative, the refractory stopper or pad may be dispensed with altogether in the initial stages of the pouring operation. In the absence of such a plug or pad, as the holding vessel is gradually filled with molten metal, the metal will enter inlet (5) and ascend the up-flow chamber (4) eventually spilling over the weir (3) to form the column in chamber (6). A drawback to this particular start procedure is that it does not enable the purge cycle to be carried out prior to pouring and does not allow for the possibility of the start of the actual pouring step to be delayed once the holding vessel has been filled with molten metal.

Once pouring through the nozzle (2) has been initiated; in order to increase throughput (hence casting speed), the height of the column in the down-flow chamber (6) is raised. This is achieved by subjecting the column to a pulse or pulses of negative pressure, for example by venting the system to atmosphere for an instant, in order to reduce the gas volume within the chamber. In so doing, the pressure momentarily deviates from the equilibrium value and a little extra input of molten metal is allowed over the weir (3), so causing the level of the liquid metal in the down-flow gallery (6) to rise. The pressure immediately restores itself to the equilibrium value after each adjustment is made, but the height ($L_3$) of the molten metal remains stable at the new level.

To decrease throughput, the height ($L_3$) of the column is lowered by increasing the gas volume in the chamber (6). This is achieved by subjecting the column to a pulse or pulses of positive pressure. Again, the pressure is momentarily displaced from its equilibrium value, slightly reducing the input over weir (3) therefore causing the level ($L_3$) of the column in chamber (6) to fall incrementally. The pressure quickly restores itself to the equilibrium value whilst level ($L_3$) remains stable at its new height. Height adjustments in the molten metal column occur immediately the appropriate control button is pressed; they may be made in very small increments for fine-tuning the out-flow. Since the response is so positive, automatic operation would maintain constant mould level and/or casting speed.

Should it be necessary to halt the liquid metal flow, the gas pressure within the chamber is increased above the equilibrium value and sustained at the higher value. This maintains the height of the up-flow column (4) below weir height, so that the down-flow column quickly drains off since input over the weir (3) no longer takes place; the ceramic pad may then be re-applied to the outlet nozzle (2) to allow system pressure to be maintained above the equilibrium pressure. If it is desired to re-start the flow, this can be achieved by repeating the start procedure although the purge cycle may be omitted.

Under normal conditions a positive system pressure creates an additional driving force to the metallostatic pressure in the column influencing throughput. Conversely, during the draining of the vessel, as the outer level falls below the weir, the negative pressure has a restraining influence so that flow-rate gradually reduces (as with normal open nozzles) as a result of intensifying negative pressure caused by the decreasing level in the vessel.

During draining of the vessel, the level $L_1$ falls, thereby decreasing the equilibrium pressure. This will decrease the out-flow rate at nozzle (2) unless the level ($L_3$) is progressively raised in order to maintain the out-flow rate. As the level $L_3$ is progressively raised, a point will be reached when the length of the molten metal column in the down-flow chamber (6) is greater than the maximum possible height of a molten metal column in the up-flow chamber (i.e. the distance between $L_3$ and the bottom of nozzle (2) is greater than the distance between inlet (5) and the top of the weir (3). At this point, the vessel will drain to completion.

Figure 2:
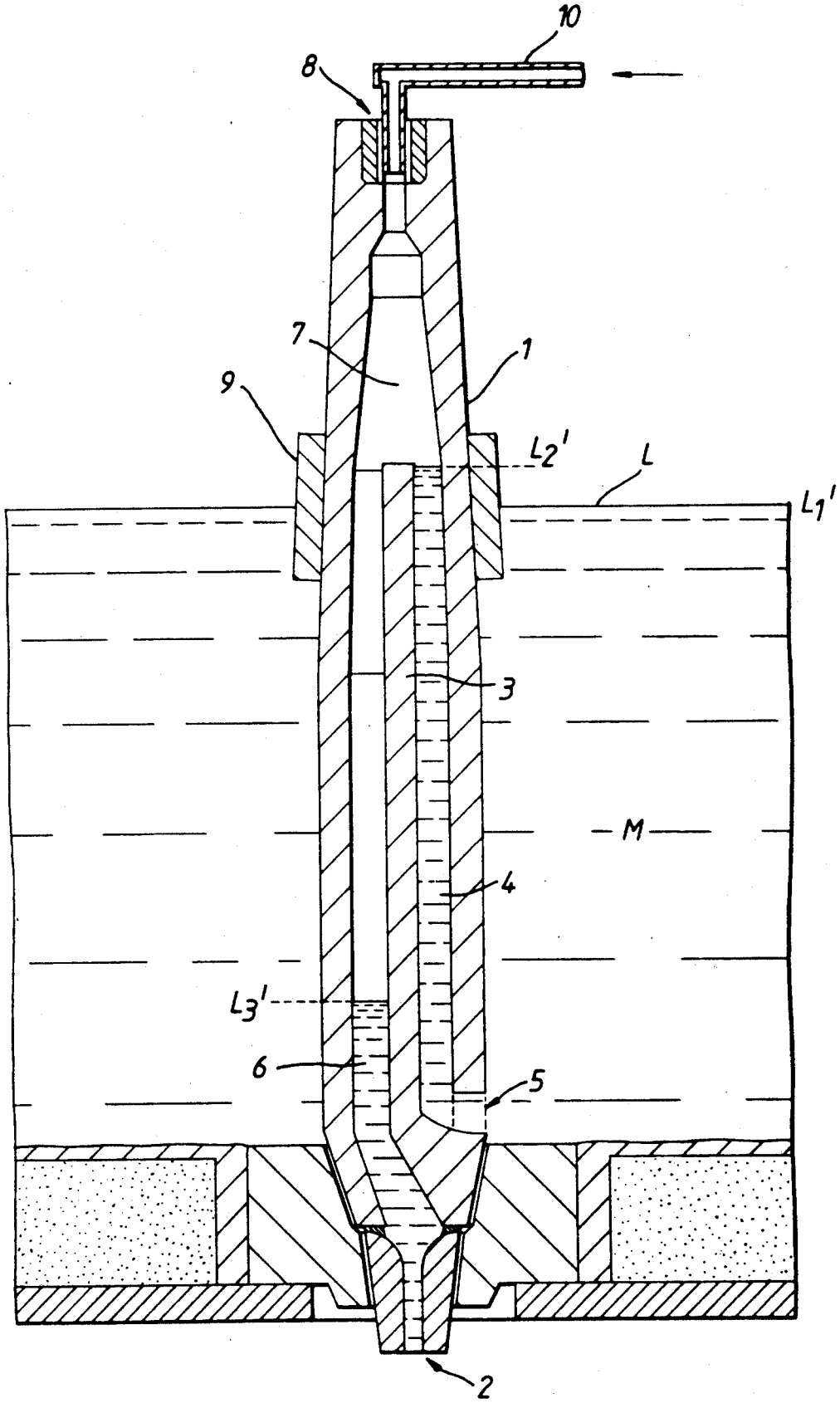
FIG. 2 is a sectional view from a side elevation of a second embodiment of the invention.

A second embodiment of the invention is illustrated in FIG. 2. As with the embodiment of FIG. 1, there is provided a tubular ceramic column (1) which is located over an outlet nozzle (2) set into the base of a melt-containing vessel such as a tundish. The column also comprises an upper tubular chamber (7) and a lower chamber divided into two galleries (4) and (6) separated by a central weir (3). As with the embodiment of FIG. 1, gallery (4) constitutes an up-flow chamber and has an inlet (5) at its lower end, whilst gallery (6) constitutes a down-flow chamber and has an outlet at its lower end leading to nozzle (6). However, the embodiment of FIG. 2 differs from the embodiment illustrated in FIG. 1 in that the top of the weir (3) is higher such that in normal use the level (L) of molten metal in the tundish will be lower than the top of the weir (3). This means that in use, the equilibrium or "critical" system pressure inside the column will be negative and the magnitude of the negative pressure will be a function of the difference in heights between $L'_1$ and $L'_2$. The requirement for a negative system pressure necessitates certain modifications to the operating procedure, as will now be explained, although the underlying principles remain the same.

The initial steps in the operating procedure are indentical or analagous to those employed with the embodiment of FIG. 1. Thus, prior to liquid metal being introduced into the holding vessel, a refractory (e.g. ceramic) plug, pad or board (not shown) is located in or over the outlet nozzle (2) in order to permit the system to be pressurised. When the vessel has been filled with molten metal, or during the filling stage, a purge cycle is initiated. The purge cycle is generally as described above but with certain modifications.

Firstly, in Stage 1 of the purge procedure, when solenoid valve (18) opens, there is no need to maintain a positive pressure within the column in order to prevent molten metal in the up-flow chamber (4) from spilling over the weir. Thus the column (1) can be vented such that the pressure therein falls to atmospheric pressure. Molten metal then ascends the column to a level ($L'_2$) which is the same as the level ($L'_1$) of metal in the holding vessel. Stages 2 and 3 of the purging procedure are as described above in relation to FIG. 1. Thus argon gas is introduced in the column to expel the liquid metal therefrom, the molten metal depth in the holding vessel is reassessed and then Stage 1 is repeated. The cycle is repeated as many times as is judged necessary by the operator.

Following the purging phase, the pouring of the molten metal can then be initiated.

By knowing the vessel depth, and weir height, the negative pressure required to raise $L'_2$ just over the weir (3) can be computed by the controller. Timed pulses of negative pressure are then supplied until the desired negative value is reached. Level $L'_2$ is thus raised above weir height so that liquid spills over into chamber (6). Pulses of negative pressure are continued for a predetermined time interval followed by isolation of the system which is achieved by closing all solenoid valves. In this way chamber (6) is 'primed' with a suitable column height. It is noteworthy that feed over the weir (3) ceases as the system is isolated in the absence of out-flow from lower nozzle 2.

In response to an appropriate signal, the removal of the plug is effected; this may be a manual operation although it could be automated. Removal of the plug initiates flow from nozzle (2).

As out-flow commences, the interior of the column remains completely isolated, although the system pressure is continually monitored. Out-flow of metal is allowed to take place in a self-regulating manner so that $L'_3$ and $L'_2$ remain steady, balanced by the entrapped gas in the upper chamber (7).

Under the circumstances described above, the equilibrium system pressure will be slightly negative, reflecting the difference in height between $L'_1$ and $L'_2$. The rate of out-flow of molten metal is determined by the ferrostatic pressure of the column in chamber (6) over the nozzle, the true net pressure being modified by the prevailing negative value of the entrapped gas in the system.

In the specific case of continuous-casting, the mould would typically be deliberately filled at a slow, steady rate; the start of withdrawal of the cast section from the mould also being slow, in accordance with safety needs at this critical time. Having commenced with a slow speed, this would be gradually increased automatically to normal operating value over a given time interval by regular pulses of negative pressure via valve (12). To increase through-put of molten metal, the system is subjected to brief pulses of negative pressure. For fine control and small incremental changes, the restricted supply from the low pressure accumulator is used. As a pulse is applied, the equilibrium pressure condition is momentarily altered and $L'_2$ is raised for an instant from its equilibrium level, causing extra liquid to enter the chamber (6) and raise $L'_3$ slightly. Isolation follows each pulse and the pressure rapidly returns to the equilibrium value and since column $L'_3$ is raised slightly after each negative pulse, the out-flow rises accordingly.

The mean system pressure remains unaffected by varying $L'_3$, and is a function only of the difference between $L'_2$ and $L'_1$. To decrease the out-flow, the procedure described above is adopted except that brief pulses of positive pressure (rather than negative pressure) are used.

To halt the out-flow, relatively positive pressure is introduced into the system via valve (13) or vent (18). Metal level $L'_2$ immediately falls, cutting off flow over the weir (3) to chamber (6), which in turn quickly empties. The column can then stand for any length of time with chamber (6) empty, without jeopardising re-start capability. Similarly, the initiation of out-flow at the start can be deferred for as long as desired.

If a re-start is required, the refractory plug is re-applied to the nozzle (2) and valve (14) opened to expel liquid from chamber 4. Vent valve (18) opens to allow fresh liquid into chamber (4) and chamber (6) is 'primed' as previously described with pulses of negative pressure. Removal of the plug initiates the flow once more and normal throughput is built up gradually as described.

According to the method of the invention, flow-control is effected by manipulating the height of the out-flow column rather than by altering the size of the nozzle orifice as in conventional methods. Column height is altered positively and rapidly in response to pulses of positive or negative pressure.

With orifice-controlling flow control devices such as sliding gates, small alterations in bore size result in relatively large increases in flow rate and therefore actuation mechanisms need to be very precise. However, an advantage of the method of the present invention is that relatively coarse alterations in column height result in relatively fine alterations in output, in accordance with the simplified relationship $Q=kd^2\sqrt{P}$ where Q is the throughput in unit mass per unit time, d is the diameter of the nozzle, P is the metallostatic pressure of the molten metal column in chamber (6) and k is a constant.

Out-flow, and hence casting speed, can be instantly altered at any desired rate to the optimum. During normal steady-state operation, the controller needs to supply only occasional pulses of either positive or negative pressure to maintain out-flow at a pre-ordained optimum value. the disadvantage inherent in certain known methods, i.e. the need for continuous flow of gas through the pouring operation, is thereby avoided.

Certain steels (e.g. aluminium killed steels) can give rise to progressive blockage of the outlet nozzles during use as a consequence of the deposition of alumina. The present method enables such blockages to be compensated for by gradually raising the out-flow column $L_3$ to maintain the casting rate, thus counteracting the effect of nozzle blockage. The situation could arise however, where $L_3$ ultimately became dangerously high, and it is preferred that the system has safeguards to prevent such problems from arising. For example, the system can be provided with one more of the following safeguards which prompt an alarm:

1. Casting speed (through-put) is affected in a predictable way following each positive or negative pressure pulse, showing a reduction or increase in out-flow (casting speed) respectively within a certain range. However, as soon as $L_3$ rises above weir height, the response alters noticeably in that less marked alterations in out-flow arise per pulse applied. The pneumatic controller may be programmed to establish an alarm condition at this point whereby a succession of positive pulses is automatically applied to lower the high level in the system.
2. The pneumatic controller may be programmed such that during normal operation, system pressure is allowed to reach only a certain maximum negative value, before prompting an alarm. This indicates that $L_2$ has reached a high level with respect to $L_1$.
3. An independent probe (not shown) may be located in the upper chamber (7) which will provide a low-voltage short to earth to operate an emergency vent valve when the molten metal level rises to an unacceptably high level.

During the draining of the vessel, when the ladle replenishing it is empty, $L_1$ falls progressively from normal operating level. A manual prompt is given to the controller that vessel draining is taking place; this disables the safeguard previously mentioned (No. 2 above) so that the high negative values arising during the drain period are permitted.

In order to drain the vessel effectively through the Flow-Control Columns, $L_3$ must be raised to about weir height in order to continue flowing against the pull of increasing negative system pressure. The normal casting rate therefore, is maintained by progressively raising $L_3$. As weir height is reached, the response rate of out-flow as each pulse is injected alters. This immediately infers that $L_3$ has reached weir height and is therefore high enough to effect the drain to completion, and the column remains isolated from this point onwards.

The advantages of the method and apparatus of the present invention are numerous. For example:

a) The refractory column is inexpensive and simple in its construction.
b) No actuator mechanism is required, since there are no moving refractory parts in the pneumatic column; considerable savings in actuator repairs and maintenance compared with other systems are, therefore, effected.
c) Existing tundishes require no modification.
d) Tundish turn-round time is rapid since the pneumatic column is easily fitted by unskilled personnel.
e) The start of cast may be delayed as long as desired.
f) Flow is initiated in a steady controlled manner to ensure trouble-free start to casting.

g) Smooth, laminar flow is preserved through the system at all times which reduces erosion or blockage tendencies. In comparison, systems employing throttled orifices create severe turbulence within the nozzle bores.

h) Flow can be arrested for long periods and restarted (the system is drained in the halt process).

i) Reliance is not placed upon the integrity of precision refractory components moving together to retain control of the flow: no moving parts are required.

j) Nozzle erosion which might arise, for example from highly erosive steel grades, is compensated for and lengthy sequence casting with these steels is possible.

k) The pneumatic control column can be used with open-pour billet casters, providing an inexpensive conversion to full flow-control capability, or with large sections which employ submerged-pouring into the mould. The widely used tube-changing system would complement the pneumatic device.

l) The start of casting may be delayed as long as desired with the vessel filled, for example if it is necessary to delay casting on one strand of a multi-strand casting machine. At any time, a steady controlled start-up can be initiated. Flow may be halted and easily re-started if necessary, even after extended halt times.

m) When it is desired to remove deposits, e.g. alumina deposit, from a nozzle, this may be achieved with a flow control column having a weir height higher than the level of molten metal in the holding vessel simply by allowing the down-flow chamber to drain and then subjecting the deposits to oxygen lancing.

Although the invention has been illustrated with particular reference to the pouring of molten metal from a tundish into a casting mould, it should be recognized that the invention is applicable to molten metal pouring operations in general and, as such, the scope of the invention is intended to be limited only by the scope of the claims appended hereto.

I claim:

1. A method of controlling the rate of flow of molten metal from a holding vessel through a discharge orifice into a receptacle the method comprising (i) disposing within the holding vessel a flow control chamber comprising a down-flow chamber separate from but in fluid communication with the interior of the holding vessel, the down-flow chamber having an outlet at its lower end, said outlet leading to or forming part of the discharge orifice, and an opening towards or at its upper end;

(ii) applying a gas pressure within the flow control chamber sufficient to allow molten metal from the holding vessel interior to pass through the opening to establish in the lower end of the down-flow chamber a column of the molten metal with a volume of gas occupying the upper end of the flow control chamber and serving to separate the column of molten metal from the opening, whereby an equilibrium is established between molten metal passing through the opening and molten metal passing out through the discharge orifice such that the height of the column of molten metal in the down-flow chamber remains substantially constant; and (iii) one of reducing said column of gas, thereby increasing the height of the column of molten metal and the flow rate through the discharge orifice or increasing said volume of gas, thereby reducing the height of said column and said flow rate.

2. The method according to claim 1 wherein there is provided an up-flow chamber, the up-flow and down-flow chambers being linked for molten metal flow therebetween by the opening towards or at the upper end of the down-flow chamber, wherein the up-flow chamber has an inlet at a point below the said opening through which molten metal from the holding vessel may pass.

3. the method according to claim 2 wherein the volume of gas in the upper end of the chamber is increased by applying thereto at least one pulse of relatively positive pressure.

4. A method of controlling the rate of flow of molten metal from a holding vessel into a receptacle comprising:

(i) disposing in said holding vessel a refractory body, the hollow interior of said body defining mutually laterally disposed first and second melt-receiving flow control chambers, said first and second chambers disposed side by side and sharing a common wall, said first and second chambers being linked for molten metal flow therebetween by an opening located at a point remote from the lower end of the chambers; the first chamber constituting an up-flow chamber and having an inlet at a point below the opening linking the first and second chambers; the second chamber constituting a down-flow chamber and having an outlet at or near its lower end through which molten metal may be dispensed, the refractory body being located within the melt-containing vessel such that said outlet is secured against a discharge orifice of the vessel; the refractory body having at least one gas port opening into said hollow interior at a point above the opening linking the first and second chambers; said at least one gas port being connected to means for selectively venting to atmosphere and lowering and raising the pressure within the chambers by supplying pulses of relatively positive or negative pressure to the hollow interior;

(ii) allowing molten metal from within the holding vessel to pass through the inlet of the up-flow chamber to ascend said up-flow chamber, and applying a system pressure within the hollow interior of the refractory body at which molten metal can flow through the opening between the first and second chambers to establish a column of molten metal in the second chamber;

(iii) allowing an equilibrium pressure to develop under which flow of molten metal through the outlet and thence through the discharge orifice is balanced by flow through said linking opening between the two chambers to maintain the column of metal at a required height; and (iv) temporarily displacing the pressure from its equilibrium value by exposing the system to a pulse or pulses of negative or positive pressure in order to effect stepwise reduction or increase of the gas volume within the chamber and increase or decrease respectively the column height in the down-flow chamber thereby to increase or decrease respectively the flow rate through the discharge chamber.

5. A method according to claim 4 wherein the flow of molten metal into the receptacle is initiated by reducing the pressure in the chambers by means of a series of timed pulses to a level whereat liquid metal passes through the opening from the up-flow chamber to the down-flow chamber to provided a molten metal column of a desired height within the down-flow chamber and, where necessary, removing any closure means closing the discharge orifice, to permit molten metal flow therethrough.

6. The method of claim 4 further comprising the steps of:

(v) allowing the molten metal level in the said vessel to fall; and (iv) incremementally reducing the system pressure to increase the height of the column of molten metal in the down-flow chamber to a level approximately to the height of the opening linking the up-flow and down-flow chambers.

7. A method according to claim 6 in which there is provided a purge cycle whereby during or following initial filling of the holding vessel with molten metal, the pressure within the up-flow and down-flow chambers is reduced to allow the molten metal to rise to a level in the up-flow chamber below the opening between the two chambers and is then increased to expel the molten metal from the up-flow chamber through the inlet thereof.

8. The method of claim 7 further comprising the steps:

(a) prior to allowing establishment of a column of molten metal in the down-flow chamber, closing the discharge orifice with a removable closure means to enable the down-flow chamber to be pressurized;

(b) creating a positive pressure within the chamber sufficient to prevent molten metal from entering the down-flow chambers; and (c) monitoring the pressure at which bubbles of gas escape from the inlet and computing therefrom the depth of molten metal in the container.

9. A flow control system for controlling the rate of flow of molten metal from a holding vessel through a discharge orifice into a receptacle comprising a holding vessel for molten metal, equipped with a flow-control chamber, the flow-control chamber being connected to a pneumatic controller capable of applying pulses of positive and negative pressure to the flow control chamber.

10. A flow control system according to claim 9 wherein the receptacle is provided with a flow-rate sensing means and the sensing means is connected in a close control loop to the pneumatic controller, to enable the pneumatic controller to vary the flow rate to the receptacle in response to a signal from the sensing means.

11. A flow control system according to claim 10 wherein there is associated with the holding vessel, a molten-metal feeder vessel for supplying molten metal to the holding vessel, the feeder vessel having flow rate control means such as a sliding gate valve for controlling the supply of molten metal to the holding vessel; the flow control system including a closed control loop between the flow rate control means and a pneumatic controller whereby the rate of supply of molten metal to the holding vessel can be varied in response to a signal from the pneumatic controller.

12. A flow control device for controlling the rate of flow of molten metal from a holding vessel through a discharge orifice into a receptacle comprising a refractory body in the form of a hollow column the hollow interior of said hollow column defines mutually laterally disposed first and second melt-receiving flow control chambers, which chambers are linked in said hollow interior for molten metal flow therebetween by an opening located at a point remote from the lower end of the chambers; the first chamber constituting an up-flow chamber and having an inlet at a point below the opening linking the first and second chambers; the second chamber constituting a down-flow chamber and having an outlet at or near its lower end through which molten metal may be dispensed, the refractory body being located within the melt-containing vessel such that said outlet is secured against a discharge orifice of the vessel; the refractory body having at least one gas port opening into said hollow interior at a point above the opening linking the first and second chambers; said at least one gas port being connected to means for selectively venting to atmosphere and lowering and raising the pressure within the chambers by supplying pulses of relatively positive or negative pressure to the hollow interior, wherein said at least one gas port is provided with means for removably connecting thereto a pneumatic controller.

13. A flow control device of claim 12 wherein the gas port or ports above the opening linking the up-flow and down-flow chambers is or are provided with means for connecting thereto a pneumatic controller, and wherein the said gas port or ports represent the only means for controllably introducing gas in the refractory body.

14. A flow control column for controlling the rate of flow of molten metal from a holding vessel through a discharge orifice into a receptacle, the column comprising a generally tubular hollow refractory body, the lower end of the interior of said hollow body being divided by a weir into up-flow and down-flow chambers, the down-flow chamber having an outlet at or near its lower end through which molten metal may be dispensed and the up-flow chamber having an inlet through which molten metal from a molten metal reservoir may pass, the inlet being located below the level of the top of the weir, the upper end of the interior of the refractory body having at least one gas port opening into the interior at a point above the level of the top of the weir, said at least one gas port constituting the sole means of introducing gas into the refractory body.

15. A method of determining the depth of molten metal in holding vessel, which method comprises:

(a) providing within the holding vessel a chamber separate from but in fluid communication with the interior of the holding vessel, the chamber having at a position towards the bottom of the holding vessel an inlet through which molten metal may pass, said inlet being disposed such that gas within the chamber cannot escape through the inlet until a gas pressure is reached within the chamber which exceeds a metallostatic pressure of the molten metal in the holding vessel;

(b) applying a pressure of gas within the chamber sufficient to prevent molten metal from entering the said inlet;

(c) applying an excess pressure of gas within the chamber and monitoring the gas pressure at which a bubble of gas is first caused to pass out of the inlet into the molten metal; and (d) relating the excess pressure of gas to the depth of molten metal in the vessel.

16. A method of controlling the rate of flow of molten metal from a holding vessel, into a receptacle comprising:

(i) disposing in said holding vessel a refractory body, the hollow interior of said body defining mutually laterally disposed first and second melt-receiving flow control chambers, said first and second chambers disposed side by side and sharing a common wall, said first and second chambers being linked for molten metal flow therebetween by an opening located at a point remote from the lower end of the chambers; the first chamber constituting an up-flow chamber and having an inlet at a point below the opening linking the first and second chambers; the second chamber constituting a down-flow chamber and having an outlet at or near its lower end through which molten metal may be dispensed, the opening linking the up-flow and down-flow chambers being in the form of a third chamber disposed above the up-flow and down-low chambers, the refractory body being located within the melt-containing vessel such that said outlet is secured against a discharge orifice of the vessel; the refractory body having at least one gas port opening into said third chamber at or near the upper end of said third chamber; said at least one gas port being connected to means for selectively venting to atmosphere and lowering and raising the pressure within the chambers by supplying pulses of relatively positive or negative pressure to the hollow interior;

(ii) allowing molten metal from within the holding vessel to pass through the inlet of the up-flow chamber to ascend said up-flow chamber, and applying a system pressure within the hollow interior of the refractory body at which molten metal can flow through the opening between the first and second chambers to establish a column of molten metal in the second chamber;

(iii) allowing an equilibrium pressure to develop under which flow of molten metal through the outlet and thence through the discharge orifice is balanced by flow through said linking opening between the two chambers to maintain the column of metal at required height; and (iv) temporarily displacing the pressure from its equilibrium value by exposing the system to a pulse or pulses of negative or positive pressure in order to effect stepwise reduction or increase of the gas volume within the chamber and increase or decrease respectively the column height in the down-flow chamber thereby to increase or decrease respectively the flow rate through the discharge chamber.

17. A method of controlling the rate of flow of molten metal from a holding vessel into a receptacle comprising:

(i) disposing in said holding vessel a refractory body, the hollow interior of said body defining mutually laterally disposed first and second melt-receiving flow control chambers, said first and second chambers disposed side by side and sharing a common wall, said first and second chambers being linked for molten metal flow therebetween by an opening located at a point remote from the lower end of the chambers; the first chamber constituting an up-flow chamber and having an inlet at a point below the opening linking the first and second chambers; the second chamber constituting a down-flow chamber and having an outlet at or near its lower end through which molten metal may be dispensed, the opening linking the up-flow and down-flow chambers being in the form of a third chamber disposed above the up-flow and down-flow chambers, the height of the third chamber being less than half the height of the second chamber; the refractory body being located within the melt-containing vessel such that said outlet is secured against a discharge orifice of the vessel; the refractory body having at least one gas port opening into said third chamber at or near the upper end of said third chamber; said at least one gas port being connected to means for selectively venting to atmosphere and lowering and raising the pressure within the chambers by supplying pulses of relatively positive or negative pressure to the hollow interior;

(ii) allowing molten metal from within the holding vessel to pass through the inlet of the up-flow chamber to ascend said up-flow chamber, and applying a system pressure within the hollow interior of the refractory body at which molten metal can flow through the opening between the first and second chambers to establish a column of molten metal in the second chamber;

(iii) allowing an equilibrium pressure to develop under which flow of molten metal through the outlet and thence through the discharge orifice is balanced by the flow through said linking opening between the two chambers to maintain the column of metal at a required height; and (iv) temporarily displacing the pressure from its equilibrium value by exposing the system to a pulse or pulses of negative or positive pressure in order to effect stepwise reduction or increase of the gas volume within the chamber and increase or decrease respectively the column height in the down-flow chamber thereby to increase or decrease respectively the flow rate through the discharge chamber.

18. A method of controlling the rate of flow of molten metal from a holding vessel into a receptacle comprising:

(i) disposing in said holding vessel a refractory body, the hollow interior of said body defining mutually laterally disposed first and second melt-receiving flow control chambers, said first and second chambers disposed side by side and sharing a common wall, said first and second chambers being linked for molten metal flow therebetween by an opening located at a point remote from the lower end of the chambers; the first chamber constituting an up-flow chamber and having an inlet at a point below the opening linking the first and second chambers; the second chamber constituting a down-flow chamber and having an outlet at or near its lower end through which molten metal may be dispensed, the opening linking the up-flow and down-flow chambers being in the form of a third chamber disposed above the up-flow and down-flow chambers, the height of the third chamber being less than half the height of the second chamber; the refractory body being located within the melt-containing vessel such that said outlet is secured against a discharge orifice of the vessel; the refractory body having a single gas port opening into said third chamber at or near the upper end of the third chamber; said at least one gas port being connected to means for selectively venting to atmosphere and lowering and raising the pressure within the chambers by supplying pulses of relatively positive or negative pressure to the hollow interior;

(ii) allowing molten metal from within the holding vessel to pass through the inlet of the up-flow chamber to ascend said up-flow chamber, and applying a system pressure within the hollow interior of the refractory body at which molten metal can flow through the opening between the first and second chambers to establish a column of molten metal in the second chamber;

(iii) allowing an equilibrium pressure to develop under which flow of molten metal through the outlet and thence through the discharge orifice is balanced by flow through said linking opening between the two chambers to maintain the column of metal at a required height; and (iv) temporarily displacing the pressure from its equilibrium value by exposing the system to a pulse or pulses of negative or positive pressure in order to effect stepwise reduction or increase of the gas volume within the chamber and increase or decrease respectively the column height in the downflow chamber thereby to increase or decrease respectively the flow rate through the discharge chamber.

19. A method of controlling the rate of flow of molten metal from a holding vessel into a receptacle comprising:

(i) disposing in said holding vessel a refractory body, the hollow interior of said body defining mutually laterally disposed first and second melt-receiving flow control chambers, said refractory body being a column in the form of a tube, the lower part of the tube being divided by a central weir into two separate galleries, said two separate galleries constitute said first and second chambers, said first and second chambers being linked for molten metal flow therebetween by an opening located at a point remote from the lower end of the chambers; the first chamber constituting an up-flow chamber and having an inlet at a point below the opening linking the first and second chambers; the second chamber constituting a down-flow chamber and having an outlet at or near its lower end through which molten metal may be dispensed, the refractory body being located within the melt-containing vessel such that said outlet is secured against a discharge orifice of the vessel; the refractory body having at least one gas port opening into said hollow interior at a point above the opening linking the first and second chambers; said at least one gas port being connected to means for selectively venting to atmosphere and lowering and raising the pressure within the chambers by supplying pulses of relatively positive or negative pressure to the hollow interior;

(ii) allowing molten metal from within the holding vessel to pass through the inlet of the up-flow chamber to ascend said up-flow chamber, and applying a system pressure within the hollow interior of the refractory body at which molten metal can flow through the opening between the first and second chambers to establish a column of molten metal in the second chamber;

(ii) allowing an equilibrium pressure to develop under which flow of molten metal through the outlet and thence through the discharge orifice is balanced by flow through said linking opening between the two chambers to maintain the column of metal at a required height; and (iv) temporarily displacing the pressure from its equilibrium value by exposing the system to a pulse or pulses of negative or positive pressure in order to effect stepwise reduction or increase of the gas volume within the chamber and increase or decrease respectively the column height in the downflow chamber thereby to increase or decrease respectively the flow rate through the discharge chamber.

20. The method of claim 4 wherein said holding vessel is a tundish.

21. The method of claim 4 wherein said receptacle is a mould.

* * * * *

UNITED STATES PATENT AND TRADEMARK OFFICE

CERTIFICATE OF CORRECTION

PATENT NO. : 5,190,674

DATED : March 2, 1993

INVENTOR(S) : JAMES H. MONKS

It is certified that error appears in the above-identified patent and that said Letters Patent is hereby corrected as shown below: On the title page, Items At [86] §371 Date, change "Oct. 3, 1991" to --Dec. 3, 1991--.

At [86] §102(e) Date, change "Oct. 3, 1991" to --Dec. 3, 1991--.

At [87] PCT Pub. Date, change "Dec. 17, 1991" to --Oct. 17, 1991-

At Attorney, Agent or Firm, change "Ingersoll Buchanan" to --Buchanan Ingersoll--.

Column 15, line 6, change "provided" to --provide--.

Column 15, line 15, change "incremementally" to --incrementally-- and change "(iv)" to --(vi)--.

Column 17, line 22, change "down-low" to --down-flow--.

Column 17, line 47, after "at" insert --a--.

Signed and Sealed this

Eighteenth Day of January, 1994

*Attest:*

Bruce Lehman

BRUCE LEHMAN

*Attesting Officer*

*Commissioner of Patents and Trademarks*